US007699670B1

(12) United States Patent
Jacques et al.

(10) Patent No.: US 7,699,670 B1
(45) Date of Patent: Apr. 20, 2010

(54) IGNITION WIRE SPARK PLUG TERMINAL ASSEMBLY

(75) Inventors: Edward H. Jacques, Sarasota, FL (US); Robert Leduc, Dandridge, TN (US)

(73) Assignee: ETCO, Inc., Warwick, RI (US)

( * ) Notice: Subject to any disclaimer, the term of this patent is extended or adjusted under 35 U.S.C. 154(b) by 0 days.

(21) Appl. No.: 12/354,363

(22) Filed: Jan. 15, 2009

Related U.S. Application Data

(60) Provisional application No. 61/021,407, filed on Jan. 16, 2008.

(51) Int. Cl.
*H01R 13/11* (2006.01)

(52) U.S. Cl. ..... 439/842

(58) Field of Classification Search ..... 439/842, 439/843, 848, 125, 839; 174/846
See application file for complete search history.

(56) References Cited

U.S. PATENT DOCUMENTS

| | | | | |
|---|---|---|---|---|
| 4,009,924 | A * | 3/1977 | Bungo et al. | 439/839 |
| 4,209,221 | A | 6/1980 | Chupak et al. | |
| 4,758,189 | A * | 7/1988 | Draxler | 439/848 |
| 4,880,389 | A * | 11/1989 | Mochizuki et al. | 439/125 |
| 5,736,678 | A * | 4/1998 | Kobayashi | 174/84 C |
| 5,951,308 | A | 9/1999 | Rea | |

* cited by examiner

*Primary Examiner*—Chandrika Prasad
(74) *Attorney, Agent, or Firm*—Steven K Martin; Altman & Martin

(57) ABSTRACT

An ignition wire spark plug terminal comprising a connector and a wire attachment. The wire attachment is adapted to attach to a wire. The connector is comprised of a ferrule and a spring clip. The ferrule is generally at least semi-cylindrical and the spring clip is a partially cylindrical band that is permanently attached coaxially to the ferrule. Dimples in the spring clip extend through holes in the ferrule into the space within the ferrule that receives a spark plug or distributor cap terminal. The permanent attachment is by weld, solder, or adhesive.

11 Claims, 3 Drawing Sheets

IGNITION WIRE SPARK PLUG TERMINAL ASSEMBLY

CROSS-REFERENCES TO RELATED APPLICATIONS

The applicant wishes to claim the benefit of U.S. Provisional Patent Application No. 61/021,407, filed Jan. 16, 2008 for SPARK PLUG TERMINAL ASSEMBLY in the names of Edward H. Jacques and Robert Leduc.

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to electrical connectors, more particularly, to connectors for connecting an ignition wire to a spark plug terminal.

2. Description of the Related Art

The terminal of an ignition wire of an internal combustion engine attaches to a spark plug 8 or distributor cap terminal. As shown in FIG. 3, the typical ignition wire terminal 50 has a attachment 52 at one end to attach to the ignition wire 54. The other end 56 that connects to the spark plug 8 or distributor cap is a generally cylindrical ferrule 58. A spring clip 60 with dimples 62 snaps into through holes in the ferrule wall. The dimples 62 snap into the center 6 of the hour-glass shaped spark plug terminal. The spring clip 60 applies a radial compression force to the spark plug terminal that helps to retain the connector on the spark plug terminal and to maintain the cylindrical shape. An insulating boot 64 fits over the connector to protect the connector and spark plug terminal. During the ignition wire manufacturing process, when the insulating boot is installed over the connector, the spring clip can become dislodged and/or dislocated, as at 66.

BRIEF SUMMARY OF THE INVENTION

An object of the present invention is to provide an ignition wire connector that maintains integrity during the booting process.

Another object is to provide an ignition wire connector that can be installed and removed from a spark plug or distributor cap terminal repeatedly without losing integrity.

The ignition wire spark plug terminal of the present invention is composed of an electrically conductive material and has a connector and a wire attachment. The wire attachment attaches the terminal to an ignition wire, many ways of which are known in the art.

The connector is a generally cylindrical ferrule with a spring clip. The ferrule has paraxial seam from the manufacturing process. The spring clip is a partially cylindrical band that attaches coaxially to the ferrule, straddling the seam. The spring clip has opposed dimples that snap into through holes in the ferrule wall and into the spark plug terminal, to more securely retain the connector on the spark plug.

The clip is permanently and solidly attached to the ferrule by any means known in the art, such as welding, soldering, and adhesives. The permanent attachment prevents the clip from being dislodged or dislocated during the booting process.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

Figure 1:
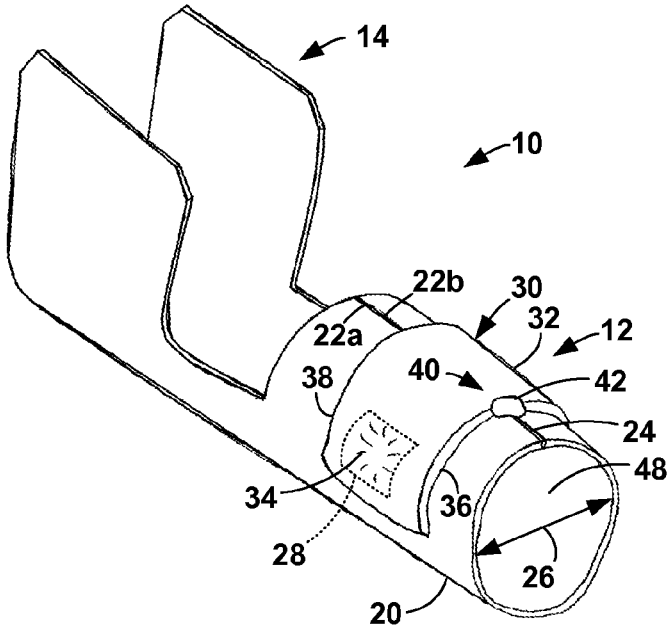
FIG. 1 is a perspective view of one configuration of the terminal of the present invention.
Figure 2:
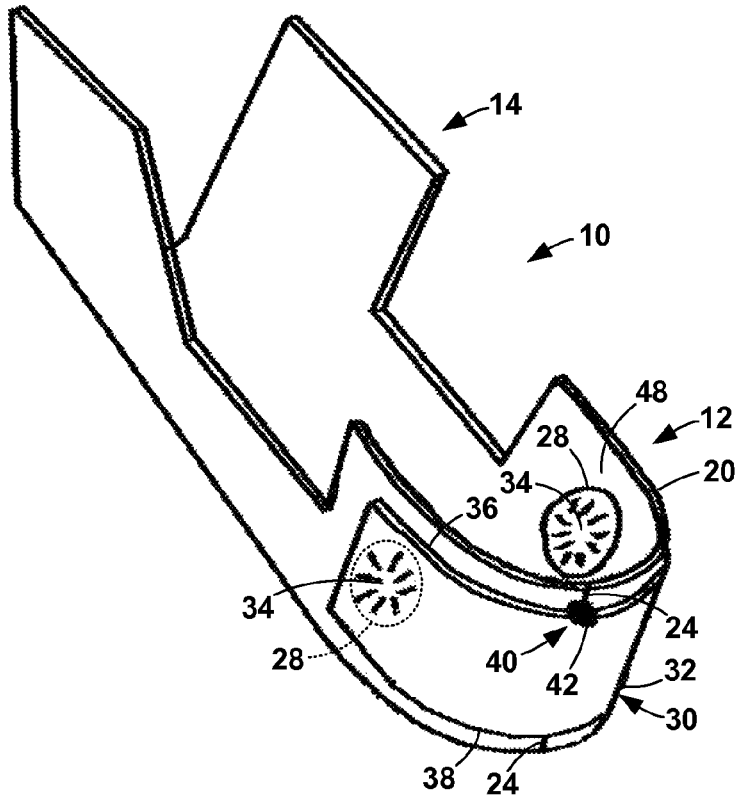
FIG. 2 is a perspective view of another configuration of the terminal of the present invention.
Figure 3:
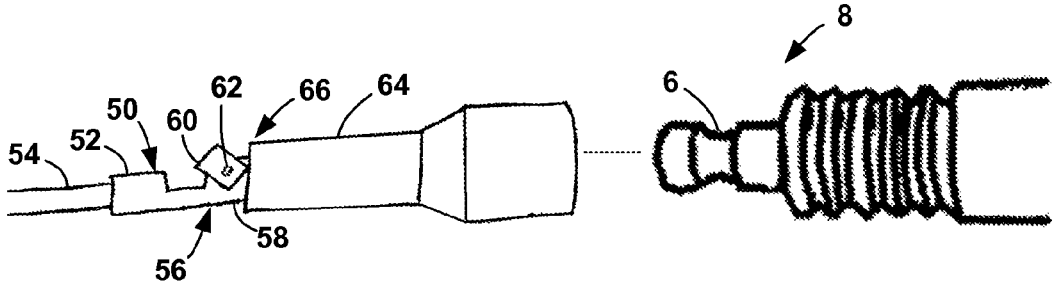
FIG. 3 is a perspective view of a prior art ignition wire terminal during the booting process.

FIGS. 1 and 2 show typical embodiments of the ignition wire spark plug terminal 10 of the present invention. The terminal 10 has a body 18 with two parts, the connector 12 of the present invention and a wire attachment 14. The body 18 is composed of an electrically conductive material, typically metallic, such as steel, stainless steel, aluminum and aluminum alloys and copper and copper alloys, the most common being brass.

The wire attachment 14 designed to attach the terminal 10 to an ignition wire 16. Different wire attachment methods are known in the art. The wire attachment 14 illustrated in the figures is a crimp of a style commonly used in the industry for attaching a connector to the end of a wire. This is merely one form of wire attachment 14. The present invention contemplates that any type of wire attachment can be used.

The connector 12, which attaches to the spark plug or distributor cap, is a ferrule 20 with a spring clip 30. The ferrule 20 is formed by curling the terminal material until the sides 22*a*, 22*b* are abutting, forming a paraxial seam 24 and a central space 48 into which the spark plug 8 or distributor cap terminal fits. In the configuration of FIG. 1, the ferrule 20 is generally cylindrical, whereas in the configuration of FIG. 2, the ferrule 20 is generally semi-cylindrical. The diameter 26 of the ferrule 20 is sized to fit snuggly onto a spark plug terminal.

Figure 4:
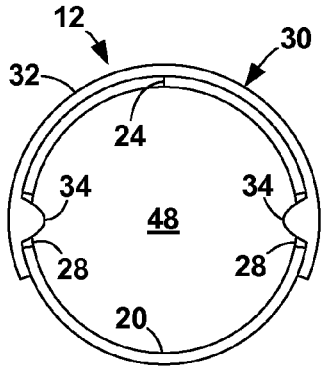
FIG. 4 is a cross-sectional view of the terminal of FIG. 1.

The spring clip 30 is a partially cylindrical band 32 that mounts to the ferrule 20 so that the clip 30 and ferrule 20 are coaxial, as in FIGS. 1 and 2. Typically, though not necessarily, the clip 30 straddles the seam 24. The spring clip 30 has opposed inwardly-extending dimples 34 that snap into through holes 28 in opposite sides of the ferrule wall, thereby retaining the clip 30 on the ferrule 20 more securely. The dimples 34 extend through the through holes 28 into the space 48 occupied by the spark plug 8 or distributor cap terminal, as in FIG. 4. When the connector 12 is installed on a spark plug 8 or distributor cap, the dimples 34 snap into the center section 6 of the hourglass-shaped spark plug or distributor cap terminal.

In the present invention, the spring clip 30 is permanently and solidly attached to the ferrule 20, as at 40. There are many means known in the art by which the permanent attachment 40 can be implemented. Examples include welding, soldering, and adhesives.

Figure 6:
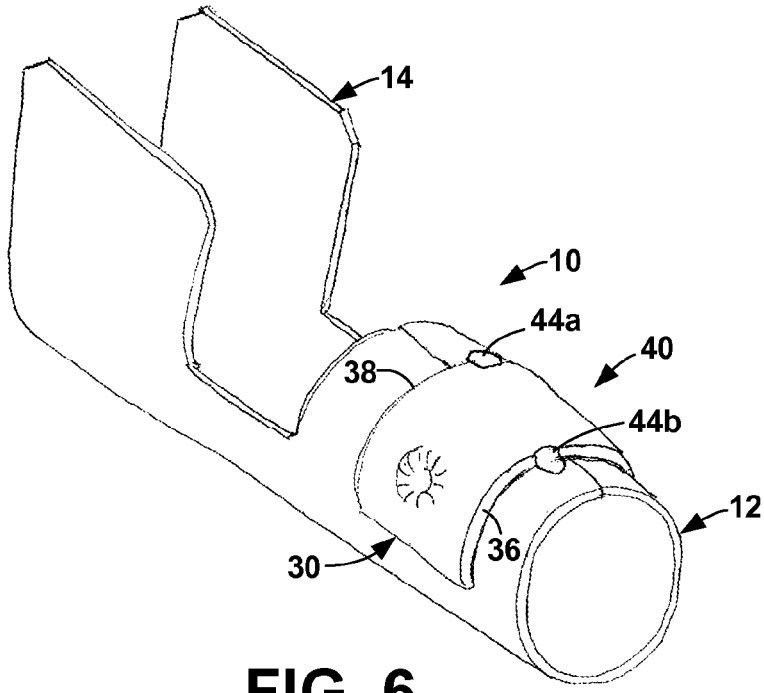
FIG. 6 is a perspective view of another configuration of the terminal of the present invention.
Figure 7:
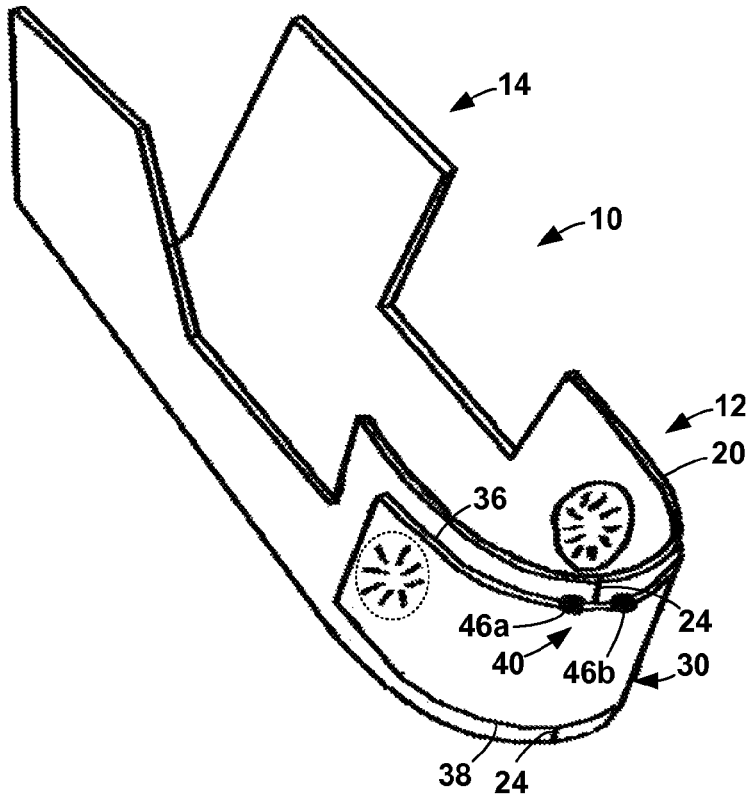
FIG. 7 is a perspective view of another configuration of the terminal of the present invention.

The location of the permanent attachment 40 can vary depending on the structure of the connector 12. Several examples are shown in the figures. In FIGS. 1 and 2, the permanent attachment 40 is a single weld 42 that straddles the seam 24 on one edge 36 of the clip 30. In FIG. 6, the permanent attachment 40 is a pair of welds 44*a*, 44*b*, one on either side of the seam 24 and on opposite edges 36, 38 of the spring 30. In FIG. 7, the permanent attachment 40 is a pair of welds 46*a*, 46*b*, one on either side of the seam 24 and on the same edge 36 of the spring 30.

Figure 5:
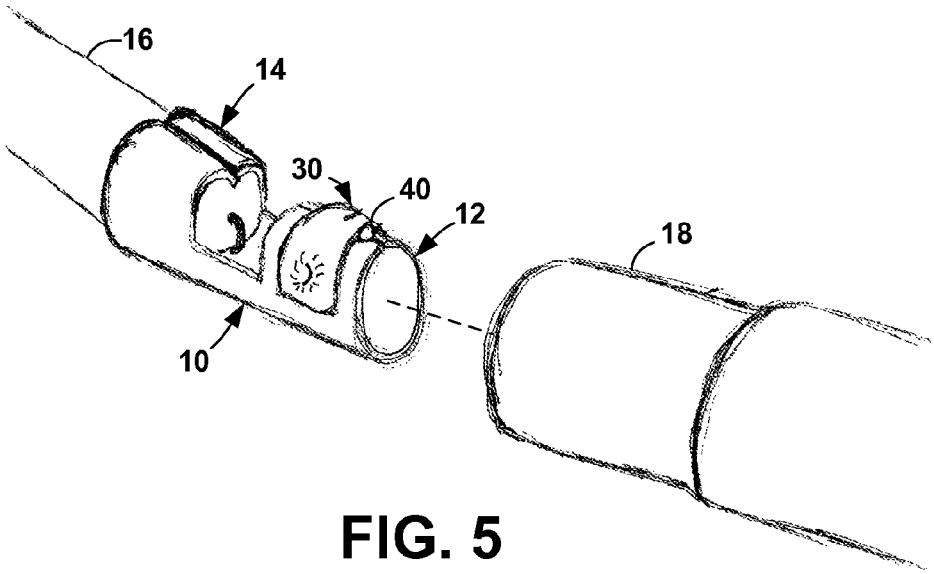
FIG. 5 is a perspective view of the terminal of FIG. 1 during the booting process.

The permanent attachment 40 prevents the clip 30 from being dislodged or dislocated during the booting process, as in FIG. 5, and adds to the rigidity of the clip 30. It also helps keep the clip 30 fastened to the ferrule 20 through repeated installation and removal of the ignition wire from the spark plug 8 or distributor cap.

Thus it has been shown and described an ignition wire spark plug terminal which satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

What is claimed is:

1. An ignition wire spark plug terminal assembly comprising:

(a) a body composed of an electrically conductive material and having a connector at one end and a wire attachment at another end;

(b) said wire attachment adapted to attach to a wire;

(c) said connector comprised of a ferrule and a spring clip;

(d) said ferrule being at least generally semi-cylindrical with opposed through holes and a central space adapted to receive a spark plug or distributor cap terminal; and (e) said spring clip being a partially cylindrical band with inwardly-extending dimples and opposed edges, said spring clip being mounted coaxially to said ferrule by said dimples snapping into said through holes and extending into said central space; and (f) a permanent attachment attaching said spring clip to said ferrule.

2. The ignition wire spark plug terminal assembly of claim 1 wherein said permanent attachment is one or more welds, solders, or adhesive.

3. The ignition wire spark plug terminal assembly of claim 1 wherein said permanent attachment is on one of said spring clip edges.

4. The ignition wire spark plug terminal assembly of claim 1 wherein said permanent attachment is on both of said spring clip edges.

5. The ignition wire spark plug terminal assembly of claim 1 wherein said ferrule has a paraxial seam with two sides.

6. The ignition wire spark plug terminal assembly of claim 5 wherein said spring clip straddles said seam.

7. The ignition wire spark plug terminal assembly of claim 6 wherein said permanent attachment is on one of said spring clip edges.

8. The ignition wire spark plug terminal assembly of claim 6 wherein said permanent attachment is on both of said spring clip edges.

9. The ignition wire spark plug terminal assembly of claim 6 wherein said permanent attachment straddles said seam.

10. The ignition wire spark plug terminal assembly of claim 9 wherein said permanent attachment is on one side of said seam.

11. The ignition wire spark plug terminal assembly of claim 9 wherein said permanent attachment is on both sides of said seam.

* * * * *